US005174140A

United States Patent [19]

Lee

[11] Patent Number: 5,174,140

[45] Date of Patent: Dec. 29, 1992

[54] TUBULAR LOCK AND MASTER TUBULAR KEY

[76] Inventor: Miko Lee, No. 5, Lihsing Lane, Chungcheng Rd., Hsinchuang City, Taipei County, Taiwan

[21] Appl. No.: 828,178

[22] Filed: Jan. 30, 1992

[51] Int. Cl.[5] ..... E05B 19/12; E05B 27/08

[52] U.S. Cl. ..... 70/491; 70/398; 70/404

[58] Field of Search ..... 70/340, 395, 398, 394, 70/403, 404, 409, 491, 496; 33/539, 540

[56] References Cited

U.S. PATENT DOCUMENTS

| | | | |
|---|---|---|---|
| 947,913 | 2/1910 | Jenkins | 70/398 |
| 2,070,342 | 2/1937 | Tarrie | 70/394 |
| 3,142,167 | 7/1964 | Christopher | 70/491 X |
| 3,270,538 | 9/1966 | Kerr | 70/394 |
| 3,330,141 | 7/1967 | Greenwald | 70/394 |
| 4,617,813 | 10/1986 | Christopher et al. | 70/398 X |
| 4,622,834 | 11/1986 | Hughes | 70/395 |

FOREIGN PATENT DOCUMENTS

| | | | |
|---|---|---|---|
| 473235 | 5/1951 | Canada | 70/395 |
| 2398163 | 3/1979 | France | 70/398 |
| 447030 | 4/1949 | Italy | 70/395 |
| 201896 | 3/1939 | Switzerland | 70/398 |
| 278505 | 2/1952 | Switzerland | 70/491 |
| 2037873 | 7/1980 | United Kingdom | 70/491 |

*Primary Examiner*—Lloyd A. Gall
*Attorney, Agent, or Firm*—Bacon & Thomas

[57] ABSTRACT

A master tubular key co-operating with a conventional lock having a tumbler consisting of a first section rotating in the lock and having a first group of tunnels through which a group of first pins being different in length are received and a second section being fixed in the lock and having a second group of tunnels corresponding to the first group of tunnels and receiving springs and a group of second pins is disclosed. The master key has a group of springs which are much stronger than those in the lock and a plurality of strips. The springs urge the strips to force the group of first pins to keep the group of second pins completely in and the group of first pins completely off the second group of tunnels, thereby allowing the first section to rotate relative to the second section.

6 Claims, 4 Drawing Sheets

TUBULAR LOCK AND MASTER TUBULAR KEY

BACKGROUND OF THE INVENTION

The present invention relates to a master tubular key which locks and unlocks a group of different keys and a combination tubular lock and master key therefor after.

Generally, referring to FIG. 3, a conventional lock for co-operating with a conventional tubular key (not shown) has a tubular lock case 70 fixed to a door or the like (not shown) and a tumbler enclosed by the lock case 70. The lock case 70 has an outward-facing opening. The tumbler consists of a first section 75, formed integral with a central portion 74, and a second section 76.

The first section has substantially a configuration of a column with a first end for restraining a tubular key in working position, a second end for rotating a bolt (not shown), and an enlarged portion between the ends. The enlarged portion of the first section 75 has a group of first tunnels extending therethrough parallel to a length of the first section 75. A first group of pins 71 is received in the first group of tunnels. In length, the first pins 71 are different from each other and are greater than the first tunnels. The first section 75 is received in the lock case 70 with the first end thereof in the opening of the tubular lock case, thereby forming an annular key hole.

The second section 76 has a configuration of a sleeve defining a central hole and a second group of tunnels each corresponding to one of the first group of tunnels and extending for the same distance therein, thereby forming a bottom. A group of identical springs 73 are each received in one of the second group of tunnels. A second group of pins 72 in which the pins are equal to each other in length and are each received in one of the second group of tunnels.

The second section 76 is fixed in the lock case 70 with the second end of the first section extending through the central hole thereof. The second group of tunnels is aligned with the first group of tunnels, so that each second pin 72 is urged partially into one of the first group of tunnels by a spring 73, thereby preventing the first section 75 from rotating relative to the second section 76.

A conventional tubular key has a tubular body having an outer periphery defining a group of channels corresponding to the first group of pins 71 and extending parallel to a length thereof. Each channel has a length corresponding to that of one of the first group of pins 71, so that a length of one of the first pins 71 minus a length of one of the channels is equal to a length of another of the first pins 71 minus a length of another of the channels. When the tubular key is inserted in the key hole, the first pins 71 are, at first ends thereof, each received in a channel of the tubular key, so that they are co-planar at second ends thereof. The first pins 71 in turn urge the second pins 72 back into the second tunnels while the first pins 71 remain in the first tunnels, thereby allowing the first section 75 to rotate relative to the second section 76.

Such locks and keys are usually employed in personal computers or video games for commercial use in casinos. Generally, a big office has many personal computers each having a unique lock co-operating with a unique key, which is kept by a clerk. A clerk might lock a personal computer and leave the office with the key. If the clerk is absent from the office, a colleague cannot retrieve data from the personal computer without the clerk, because the personal computer is not accessible without the key. To solve such problem, a number of spare keys must be stored in the office. In a casino, there are many video games each having a unique lock co-operating with a unique key. A casino keeper needs to store a number of keys in order to access every video game to retrieve coins therefrom. Both instances are not convenient. Therefore, the present invention is intended to solve this problem.

SUMMARY OF THE INVENTION

The present invention provides a master tubular key cooperating with a conventional tubular lock having a tumbler consisting of a first section rotating in the lock and having a group of first tunnels in which a group of first pins of different lengths are received and a second section being fixed in the lock and having a group of second tunnels corresponding to the group of first tunnels and receiving springs and a group of second pins. The master key has a group of springs which are much stronger than those in the lock and a plurality of strips. The springs urge the strips to force the group of first pins to keep the group of second pins completely in and the group of first pins completely out of the group of second tunnels, thereby allowing the first section to rotate relative to the second section.

For a better understanding of the present invention and objects thereof, a study should be made to the detailed description of below-mentioned embodiments, in relation to the accompanying drawings.

DETAILED DESCRIPTION OF THE PREFERRED EMBODIMENT

This invention is to be understood by description of the preferred embodiments in relation to the drawings.

Figure 3:
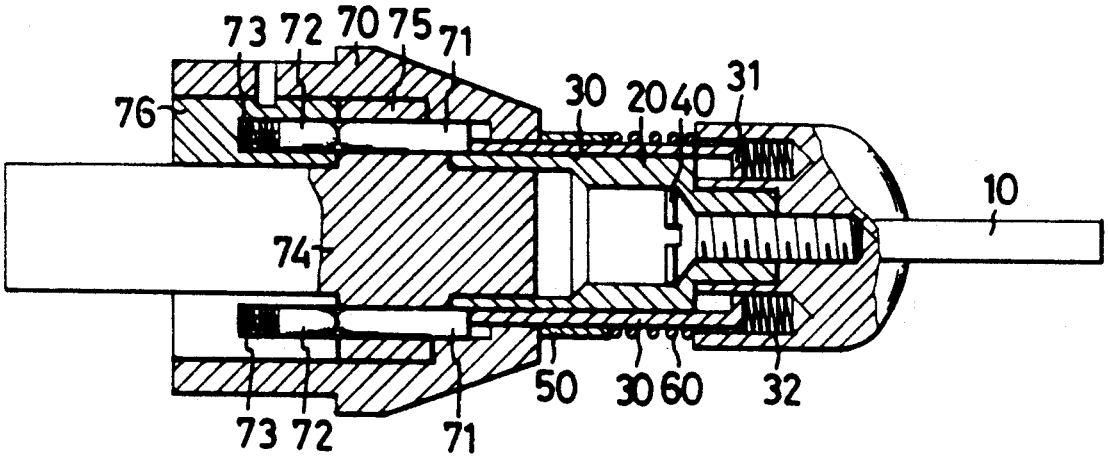
FIG. 3 is a cross-sectional view of a master tubular key in accordance with a first embodiment of the present invention co-operating with a conventional tumbler.

Generally, referring to FIG. 3, a conventional tubular lock has a tubular lock case 70 fixed to a door or the like (not shown) and a tumbler enclosed by the lock case 70. The lock case 70 has an outward-facing opening. The tumbler consists of a first section 75 and a second section 76.

The first section has substantially a configuration of a column with a first end for restraining a tubular key in working position, a second end for rotating a bolt (not shown), and an enlarged portion between the ends. The enlarged portion of the first section 75 has a group of first tunnels extending therethrough parallel to a length of the first section 75. A group of first pins 71 are each received in a corresponding one of the first tunnels. In length, the first pins 71 are different from each other and are greater than the first tunnels. The first section 75 is received in the lock case 70 with the first end thereof in the opening of the tubular lock case, thereby forming an annular key hole.

The second section 76 has a configuration of a sleeve defining a central hole and a group of second tunnels each corresponding to one of the first tunnels and extending for the same distance therein, thereby forming a bottom. A group of identical springs 73 are each received in one of the second tunnels. A group of second pins 72 which are equal to each other in length are each received in one of the second tunnels.

The second section 76 is fixed in the lock case 70 with the second end of the first section extending through the central hole thereof. The second tunnels are aligned with the first tunnels, so that each of the second pins 72 is urged partially into one of the first tunnels by a spring 73, thereby preventing the first section 75 from rotating relative to the second section 76.

Figure 1:
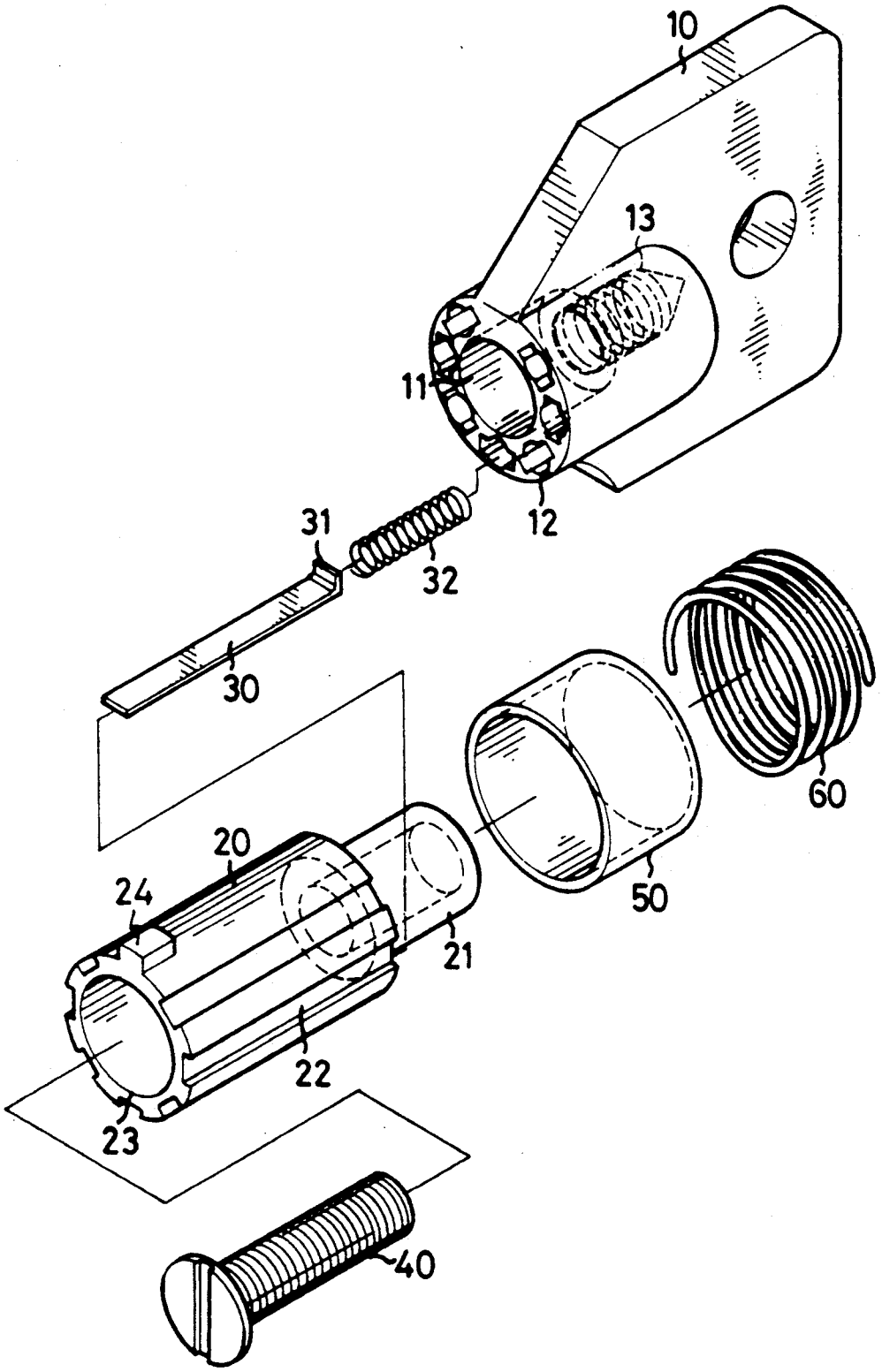
FIG. 1 is an exploded view of a master tubular key in accordance with a first embodiment of the present invention.
Figure 2:
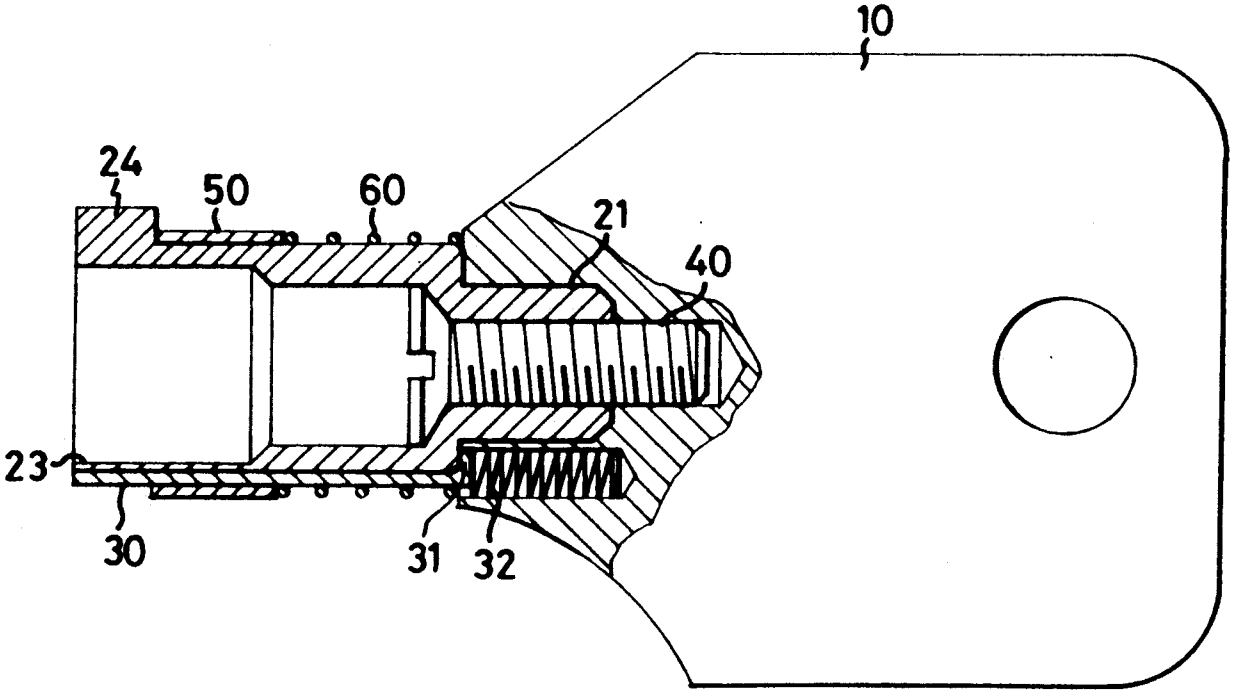
FIG. 2 is a cross-sectional view of a master tubular key in accordance with a first embodiment of the present invention.

Referring to FIGS. 1 and 2, a key has a handle 10. The handle 10 is formed with a cavity 11 which is enclosed by a tubular wall integrated therewith and has a bottom. A group of tunnels 12 extends in the tubular wall parallel to an axis of the cavity 11. Each tunnel 12 is aligned with one of the first tunnels and formed with a cross-section derived from the overlapping of a circle and a rectangle, thereby defining a common center. A length of the rectangle is perpendicular to a line passing a center of the cavity 11 and the center of the tunnel 12. A threaded tunnel 13 extends co-axially in the bottom of the cavity 11.

A tubular body 20 has a discretely tapered first end 21 and a second end. The first end 21 fits in the cavity 11 of the handle 10. An outer diameter of the tubular body 20 is the same as that of a circle passing the centers of the tunnels 12. A plurality of grooves 22 extend on an outer periphery of the tubular body 20 parallel to an axis of the tubular body 20 and each correspond to a tunnel 12. The tubular body includes a central bore 23 and is formed with a bit 24 on the outer periphery at the second end.

A spring 32 which, when not loaded, is as long as the tunnel 12 and much stronger than the spring 73. A strip 30 has a bent end 31 extending perpendicular thereto. A shape of the bent end 31 corresponds to the rectangular portion of the tunnel 12. The strip 30 is received in each groove 22 with the bent end 31 extending toward the axis of the tubular body 20, so that the strip 30 will not be projected out of the groove 22 by the spring 32.

Side by side, a collar 50 and a spring 60 enclose the tubular body 20 and the strips 30. The end 21 is received in the cavity 11. Each strip 30 is aligned with a tunnel 12, so that when the strip 30 is moved in the groove 22 toward the handle 10, the strip 30 is received in the tunnel 12, thereby compressing a spring 32. The collar 50 and the spring 60 are disposed between the bit 24 and the handle 10, so that the collar 50 is biased by the spring 60 toward the bit 24. A threaded bolt 40 with a head is inserted through the tubular body 20 and the tapered end 21 and secured to the threaded tunnel 13, thereby fixing the tubular body 20 to the handle 10.

Referring back to FIG. 3, a master tubular key in accordance with a first embodiment of the present invention is shown to co-operate with a conventional lock. The tubular body 20 of the key is inserted in the annular key hole with each strip 30 aligned with one of the first pins 71. As the springs 32 are much stronger than the springs 73, a force of the spring 32 is stronger than a resistance of the spring 73, thereby urging the first pins 71 to force the second pins 72 completely in the second tunnels. The springs 32 are compressed to different extents in order to compensate the differences of the lengths of the first pins 71, so that the first pins 71 are maintained in the first section 75, thereby allowing the first section 75 to rotate relative to the second section 76.

The key in accordance with the first embodiment of the present invention locks and unlocks all conventional tubular locks. But a casino keeper would not wish others to access his video games. Therefore, a key in accordance with a second embodiment of the present invention provides a unique master tubular key for a corresponding group of locks.

Figure 4:
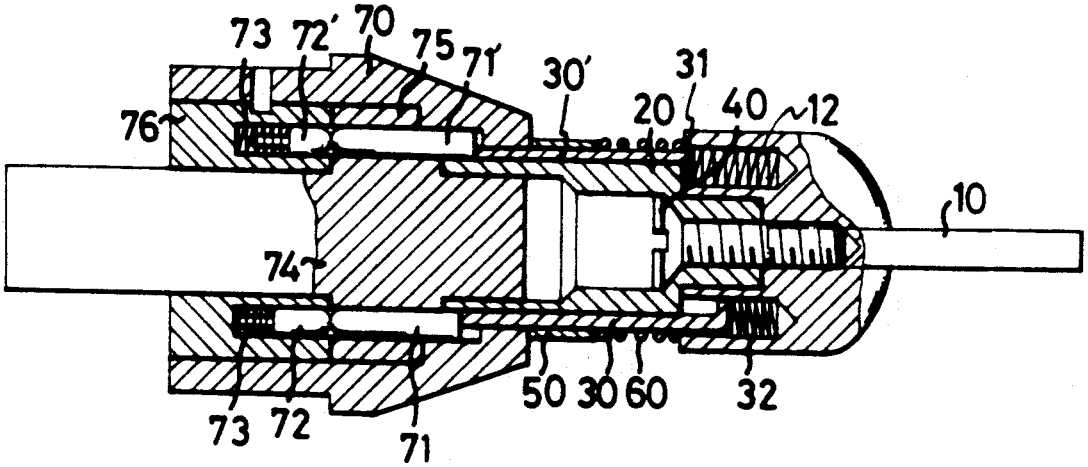
FIG. 4 is a cross-sectional view of a master tubular key co-operating with a tumbler in accordance with a second embodiment of the present invention.

Referring to FIG. 4, in accordance with a second embodiment of the present invention, a pin 72' is shorter than the remaining of the second pins 72. If a key as shown in FIGS. 1–3 is inserted in the annular key hole, a spring 32 would urge a strip 30 to force one of the first pins 71 partially in one of the second tunnels, as the pin 72' is shorter than the remaining of the second pins 72. A strip 30' and a first pin 71' are adapted for cooperating with the pin 72'. The length of the strip 30' plus the length of the first pin 71' is equal to the length of the tubular body 20 plus the length of the enlarged middle portion of the first section 75. In use, the tubular body 20 is completely inserted in the annular key hole, i.e., the tubular body 20 abuts the enlarged middle portion of the first section 75. One spring 32 urges bent end 31 of strip 30' to cause pin 71' to move pin 72', thereby compressing spring 73. The spring 32 is much stronger than the spring 73 such that a recovering force of the spring 73 cannot overcome a recovering force of the spring 32 even if spring 32 is only compressed for an amount which is the same as the thickness of the bent end 31. In fact, the spring 32 would further displace strip 30' towards the second tunnel against the biasing force of spring 73 if not for the fact that bent end 31 abuts against tubular body 20. In such a position, the strip 30' is completely urged out of the tunnel 12 except for the bent end 31. As the length of the strip 30' plus the length of the first pin 71' is equal to the length of the tubular body 20 plus the length of the enlarged middle portion of the first section 75, the second pins 72 and 72' are retained in the second tunnels, thereby permitting the first section 75 to be rotated relative to the second section 76. Therefore, the FIG. 4 embodiment differs from that shown and disclosed with reference to the FIG. 3 embodiment only with regards to the length of pins 71', 72', as compared to the length of pins 71, 72, the length of strip 30' as compared to the length of strips 30 and the biasing force or spring rate of the spring 32 that biases strip 30' as compared to the biasing force of the spring 32 that biases strips 30.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

I claim:

1. A master tubular key comprising:

a handle including a cylinder having a central cavity and a group of peripheral tunnels extending parallel to said cavity;

a tubular body including a first section fixed in said cavity, a second section integrated with a bit, and a group of peripheral channels extending along said second section and aligned with said tunnels of said handle;

a group of springs each received in a corresponding one of said tunnels of said handle;

a group of strips each being slidably received in a corresponding one of said channels and urged by a respective one of said springs; and means for restraining said strips in said channels.

2. A master tubular key in accordance with claim 1, wherein said means for restraining said strips in said channels comprises a spring enclosing said strips and said tubular body between said bit and said handle.

3. A master tubular key in accordance with claim 1, wherein said means for restraining said strips in said channels comprises:

a collar enclosing said strips and said tubular body in a vicinity of said bit; and a spring enclosing said strips and said tubular body against said handle, thereby urging said collar toward said bit.

4. A lock-and-key assembly comprising:

a lock including:

a tubular lock case having an opening; and a tumbler residing in said lock case and having:

a first section defining a first end residing in said opening, thereby forming an annular key hole, a second end for rotating a bolt, and an enlarged middle portion formed with a group of longitudinally extending first tunnels;

a group of first pins being different to each other in length and each received in a corresponding one of said first tunnels;

a second section defining a central hole through which said second end of said first section penetrates and a group of second tunnels corresponding in number and adapted to be aligned with said first tunnels;

a group of springs each residing in a corresponding one of said group of second tunnels; and a group of second pins each residing in a corresponding one of said second tunnels; and a key including:

a handle having a cylinder with a central cavity and a group of peripheral tunnels extending parallel to said cavity;

a tubular body comprising a first section fixed in said cavity, a second section integrated with a bit, and a group of peripheral channels extending along said second section and aligned with said tunnels of said handle;

a group of springs, which are much stronger than said springs in said second tunnels, each received in a corresponding one of said tunnels of said handle;

a group of strips each being slidably received in a respective one of said channels and biased by a corresponding one of said stronger springs; and means for restraining said strips in said channels;

wherein at least one of said group of second pins is shorter than the remaining of said group of second pins and one of said group of strips co-operates with its corresponding said first pin to urge said shorter second pin completely within its respective second tunnel while said corresponding first pin is retained in its respective said first tunnel when said tubular body of said key abuts said enlarged middle portion of said first section of said tumbler.

5. A lock-and-key assembly in accordance with claim 4, wherein said means for restraining said strips in said channels comprises a spring enclosing said strips and said tubular body between said bit and said handle.

6. A lock-and-key assembly in accordance with claim 4, wherein said means for restraining said strips in said channels comprises:

a collar enclosing said strips and said tubular body in a vicinity of said bit; and a spring enclosing said strips and said tubular body against said handle, thereby urging said collar towards said bit.

* * * * *